US007207831B2

(12) United States Patent
Chen

(10) Patent No.: US 7,207,831 B2
(45) Date of Patent: Apr. 24, 2007

(54) POWER CONNECTOR MEETING SATA AND IDE STANDARDS

(75) Inventor: Michael Chen, Xiandian (TW)

(73) Assignee: Topower Computer Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/341,719

(22) Filed: Jan. 30, 2006

(65) Prior Publication Data

US 2006/0234543 A1 Oct. 19, 2006

Related U.S. Application Data

(63) Continuation-in-part of application No. 11/107,930, filed on Apr. 18, 2005, now Pat. No. 7,101,221.

(51) Int. Cl.
*H01R 3/00* (2006.01)

(52) U.S. Cl. ..... 439/497; 439/101

(58) Field of Classification Search ..... 439/497, 439/101, 924.1, 941, 502
See application file for complete search history.

(56) References Cited

U.S. PATENT DOCUMENTS

| | | | | |
|---|---|---|---|---|
| 5,044,971 | A | 9/1991 | Hollingsworth | |
| 6,790,094 | B1 | 9/2004 | Bergmann et al. | |
| 6,818,825 | B2 | 11/2004 | Tharman | |
| 6,878,889 | B1 | 4/2005 | Horst et al. | |
| 7,118,411 | B2 * | 10/2006 | Huang et al. | 439/502 |
| 7,121,890 | B2 * | 10/2006 | Chang | 439/610 |
| 2001/0016438 | A1 * | 8/2001 | Reed | 439/101 |
| 2004/0115988 | A1 * | 6/2004 | Wu | 439/497 |
| 2004/0248462 | A1 | 12/2004 | Dyer et al. | |
| 2005/0191897 | A1 * | 9/2005 | Kondou et al. | 439/497 |

FOREIGN PATENT DOCUMENTS

TW M279907 U 11/2005

* cited by examiner

*Primary Examiner*—J. F. Duverne
(74) *Attorney, Agent, or Firm*—Birch, Stewart, Kolasch & Birch LLP

(57) ABSTRACT

The present invention discloses a power connector meeting SATA and IDE standards, which has a SATA connect port and an IDE connect port respectively disposed on its both sides and contains multiple live-wire power terminals L and multiple ground-wire power terminals G, wherein the power terminals of the IDE connect port are arranged according to the sequence: L, G, G, L; the SATA connect port has at least the power terminals corresponding to the IDE connect port in potential, and the power terminal of the SATA connect port are arranged according to the sequence: L, G, L, G; the live-wire power terminal L, which has a non-equipotential opposite power terminal, may utilize a crooked and raised connection segment to cross over the other connection segments and to connect with another equipotential live-wire power terminal.

18 Claims, 7 Drawing Sheets

POWER CONNECTOR MEETING SATA AND IDE STANDARDS

This application is a continuation-in-part, and claims priority, of from U.S. patent application Ser. No. 11/107,930 filed on Apr. 18, 2005 now U.S. Pat. No. 7,101,221, entitled "POWER TRANSMISSION CABLE".

FIELD OF THE INVENTION

The present invention relates to a power transmission connector, particularly to a power connector, which meets SATA and IDE standards.

BACKGROUND OF THE INVENTION

The early-stage ATA (AT Attachment, or currently called IDE interface) transmission interface is used in hard discs or compact discs and functions as the bridge between CPU and a hard disc to implement the mass and fast data transference therebetween. With the progress of technology, various extensions have been derived from such a transmission interface, for example, Ultra ATA, Ultra ATA/66, and currently prevailing Ultra ATA/100. Those derived standards not only can obviously increase the correctness of data transmission but also can greatly promote the transmission rate to as high as 100 MB/sec. Owing to the persistent technological advance, the industry further provides a new standard—SATA (serial ATA), which is also an extension of ATA and maintains original ATA hardware standard but transforms the signal transmission terminals from the original parallel mode (such as SCSI and parallel ports) to a serial mode (such as USB and IEEE1394). Thereby, SATA not only can provide a transmission rate as high as 150 MB/sec but also can support the hot-plug function and is compatible with the software and the drive program of the current parallel ATA. Therefore, SATA is superior to current standards. Furthermore, second generation SATA has also appeared, and its transmission rate can reach even 300 MB/sec.

A power supply is usually installed to a computer or a server to transform AC current into stable DC currents of different voltages and provide power for peripherals. The abovementioned power supply generally has +12V, +5V, and +3V DC outputs, which are usually conducted by an IDE 4-pin power connector or a SATA power connector. The 4-pin power connector outputs +12V and +5V DC, and SATA power connector outputs +12V, +5V, and +3.3V DC. For the detailed data, please refer to Taiwan Patent publication No.M279907 "Collinear Device for SATA and Peripherals", wherein there are four wires to provide power for 4-pin power connector, including: the first yellow wire, which outputs +12V DC, the second black wire and the third black wire, which are ground wires, and the fourth red wire, which outputs +5V DC; there are five wires to provide power for a SATA power connector, including: the first yellow wire, which also outputs +12V DC, the second black wire, which is ground wire, the third red wire, which outputs +5V DC, the fourth black wire, which is also ground wire, and the fifth orange wire, which outputs +3.3V DC. From those described above, it is known: as to the numbers of output wires, there is a difference between a 4-pin power connector (4 wires) and a SATA power connector (5 wires); as to the output DC powers, there is both a difference and a commonness between a 4-pin power connector and a SATA power connector. In the practice of power supplies, a 4-pin power connector and a SATA power connector respectively use four wires and five wires to obtain power from a power supply, and the ends of those wires connect to the sockets of the 4-pin power connector and the SATA power connector. Owing to required multiple sets of supply voltages and required multiple sets of wires connecting the DC voltage supply and the sockets of the 4-pin power connector and the SATA power connector, the internal wires of a power supply are numerous and messy, and the structure of the power supply is also complicated; thus, the fabrication cost thereof is higher. As users use various kinds of motherboards and peripherals, the manufacturer has to prepare multitudinous 4-pin power connectors and SATA power connectors to meet users; usually, one of them may be insufficient to supply all peripherals, and the other is surplus to cause waste, which besets users very much, and increases the cost of stock management.

SUMMARY OF THE INVENTION

To meet the industry specification and promote the usage convenience, the present invention proposes a new power connector to achieve the objective that the conventional power connectors cannot achieve.

The primary objective of the present invention is to provide a power connector, which has a SATA connect port and an IDE connect port respectively disposed on its both sides to enable the user to transform the original SATA power supply into an IDE power supply so that IDE-related peripherals can obtain required power. Thereby, users can easily switch SATA power supply into IDE power supply by themselves. Further, as the manufacturers only need to provide SATA power connectors, they can also benefit from the reduced cost of stock management.

To achieve the abovementioned objective, the present invention proposes a Power connector meeting SATA and IDE standards, wherein one side of the power connector is a SATA connect port, and the other side is an IDE connect port; the power connector of the present invention contains multiple live-wire terminals of (L) and ground-wire terminals (G); the power terminals of the IDE connect port are arranged according to the sequence: L, G, G, L; the SATA connect port has at least the terminals corresponding to the IDE power terminals in potential, and the power terminals of the SATA connect port are arranged according to the sequence: L, Q L, G; the live-wire power terminal, which has a non-equipotential opposite power terminal, may utilize a raised and crooked connection segment to cross over the other connection segments and to connect with another equipotential live-wire power terminal.

DETAILED DESCRIPTION OF THE PREFERRED EMBODIMENTS

Below, the technical contents of the present invention are to be described in cooperation with the drawings.

Figure 1:
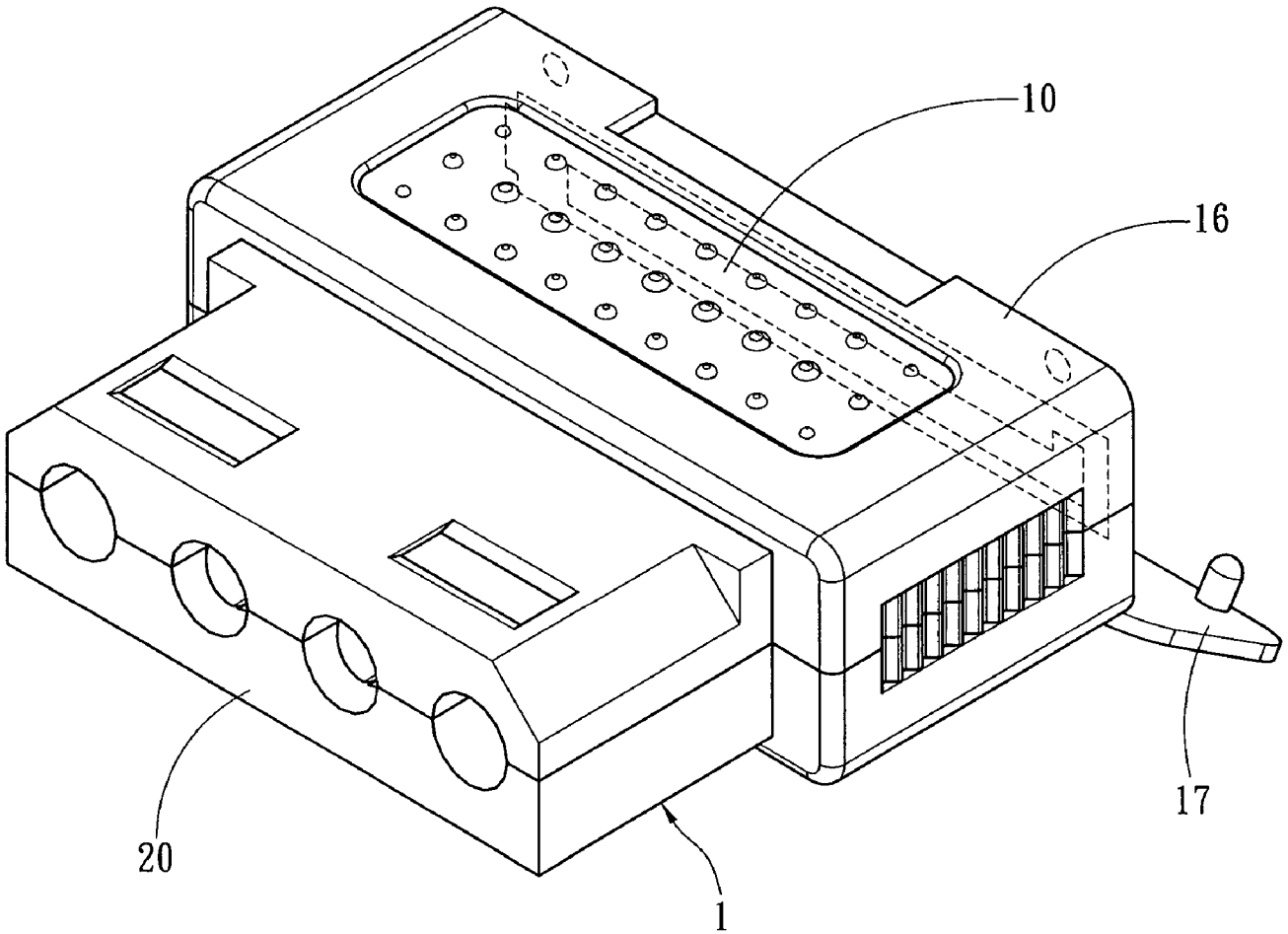
FIG. 1 is a diagram schematically showing a perspective view of the power connector according to one embodiment of the present invention.
Figure 2:
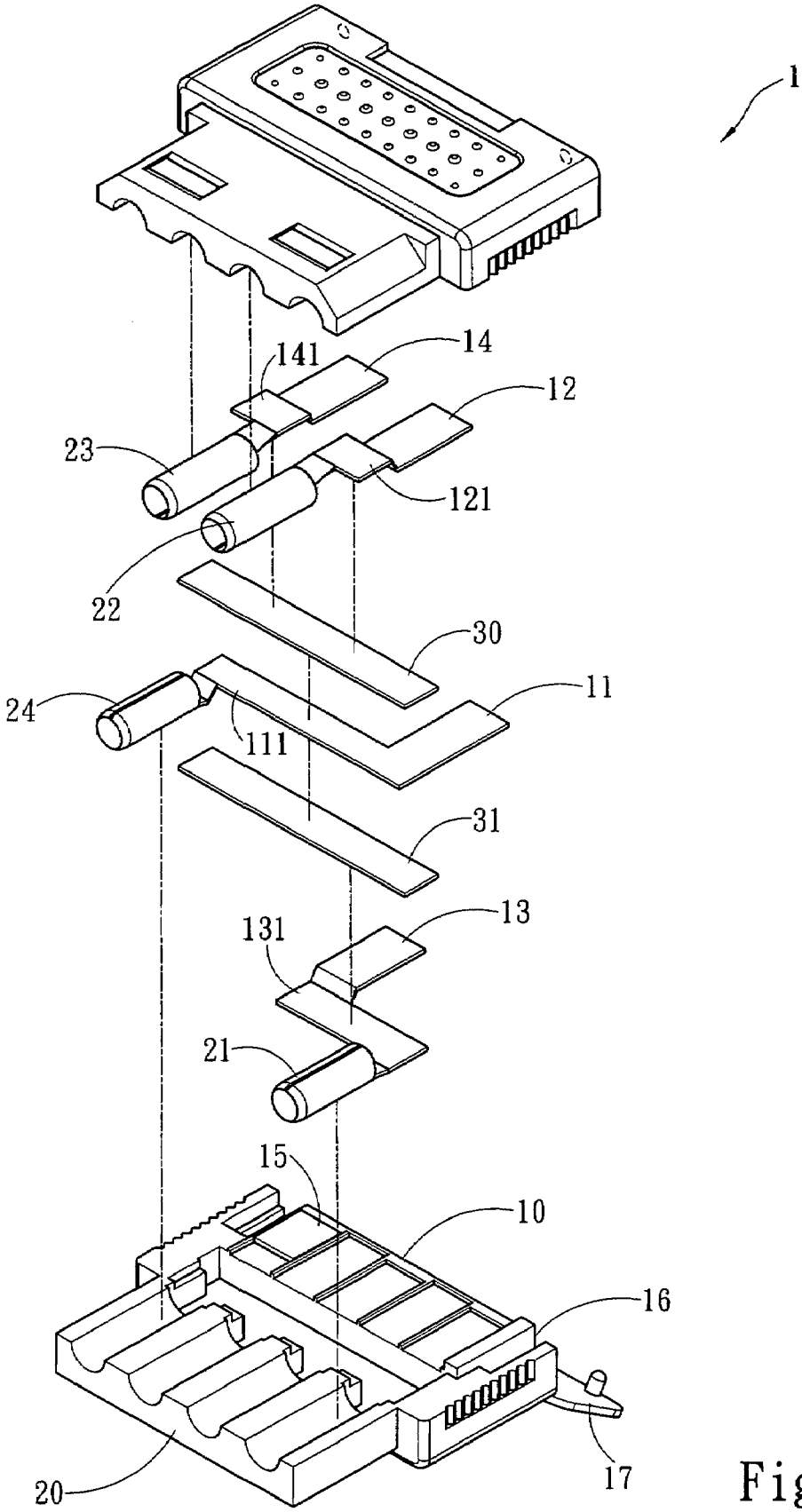
FIG. 2 is a diagram schematically showing an exploded view of the power connector according to one embodiment of the present invention.
Figure 3:
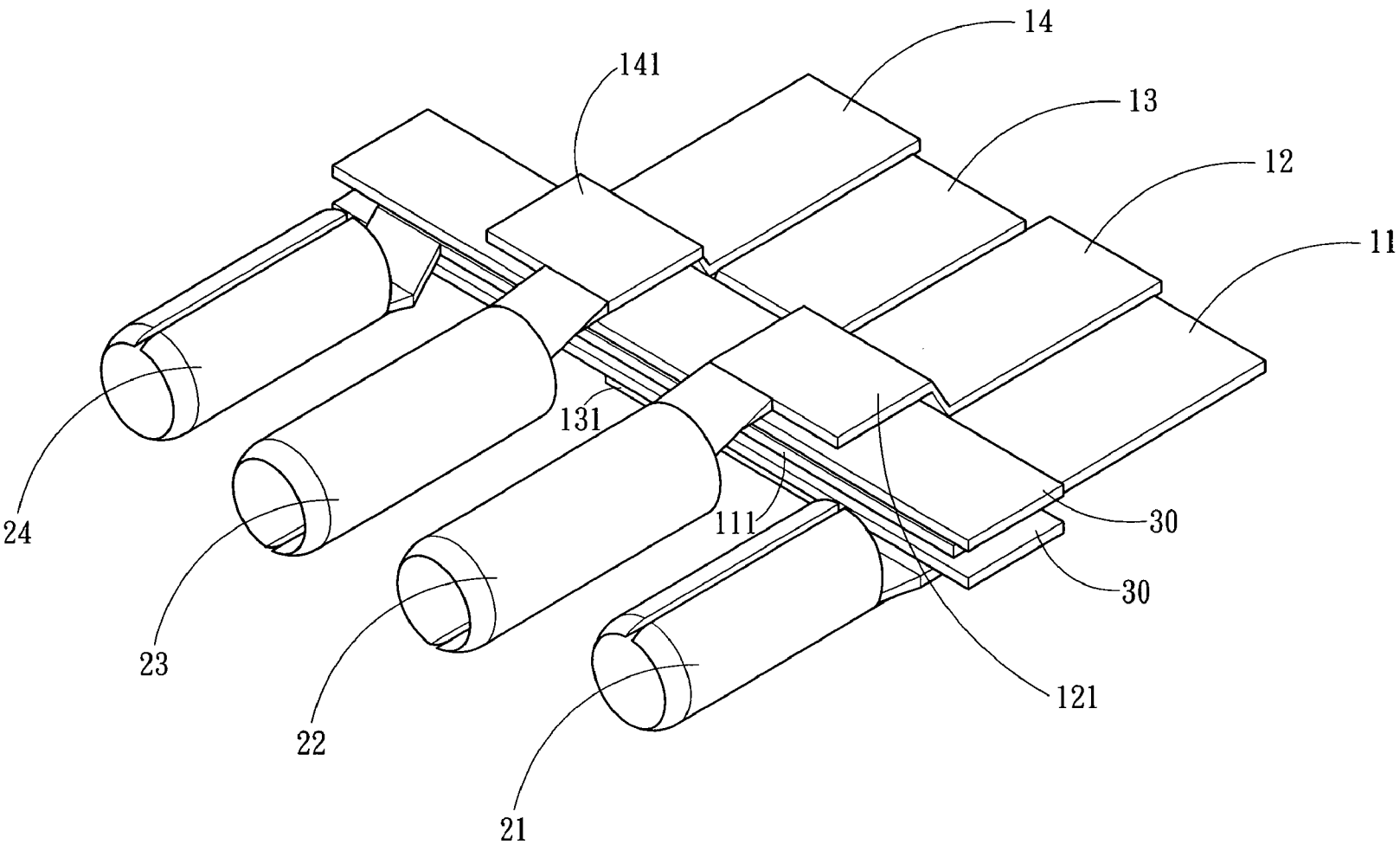
FIG. 3 is a diagram schematically showing the terminal arrangement of the power connector according to one embodiment of the present invention.

Refer to FIG. 1, FIG. 2, and FIG. 3 diagrams schematically showing a perspective view, an exploded view, and terminal arrangement according to one embodiment of the present invention. As shown in the drawings, the present invention is a power connector 1 meeting SATA and IDE standards. One side of the power connector 1 is a SATA connect port 10, and the other side is an IDE connect port 20. The SATA connect port 10 and the IDE connect port 20 are on parallel planes. The power connector 1 contains multiple power terminals 11~14 and 21~24 consisting of a plurality of live wires (L) and ground wires (G). The power terminals 11~14, which are composed of live wires and ground wires, have connection segments 111~141, which connect the power terminals 11~14 respectively to the corresponding equipotential power terminals 21~24. The power terminals 21~24 of the IDE connect port 20 are arranged according to the sequence: L, G, G, L; the SATA connect port 10 has at least the terminals corresponding to the IDE connect port 20 in potential, and the power terminals 11~14 of the SATA connect port 10 are arranged according to the sequence: L, G, L, G. In this embodiment, the ground-wire power terminals 12 and 14 are of equipotential; the ground-wire power terminals 22 and 23 also have the same potential as the terminals 12 and 14; the ground-wire power terminals 22 and 23 are respectively opposite to the ground-wire terminals 12 and 14; therefore, the terminals 12 and 14 can utilize the connection segments 121 and 141 to directly butt with the terminals 22 and 23 without turnings. The live-wire power terminals 11 and 13 are of different potentials and utilize the crooked and raised connection segments 111 and 131 to respectively cross over the connection segments 121 and 141 of the neighboring ground-wire power terminals 12 and 14 and to respectively connect with the equipotential live-wire power terminals 24 and 21. The connection segments 111 and 131 of the live-wire power terminals 11 and 13 are respectively raised with different increments to cross over the connection segments 121 and 141 of the live-wire power terminals 12 and 14. An insulation element 30 is interposed between the level of the connection segments 121 and 141 of the ground-wire power terminals 12 and 14 and the level of the connection segment 111 of the live-wire power terminal 11; an insulation element 31 is interposed between the connection segment 111 of the live-wire power terminal 11 and the connection segment 131 of the live-wire power terminal 13 lest those connection segments are short-circuited owing the electric contact therebetween. A cover 17 is pivotedly installed to the opening 16 of SATA connect port 10 to protect the internal power terminals 11~14 from pollutants lest those terminals be damaged and the electric connection thereof be influenced. As the power connector 1 is a SATA/IDE conversion connector, the remaining potential is an empty potential 15.

Figure 4:
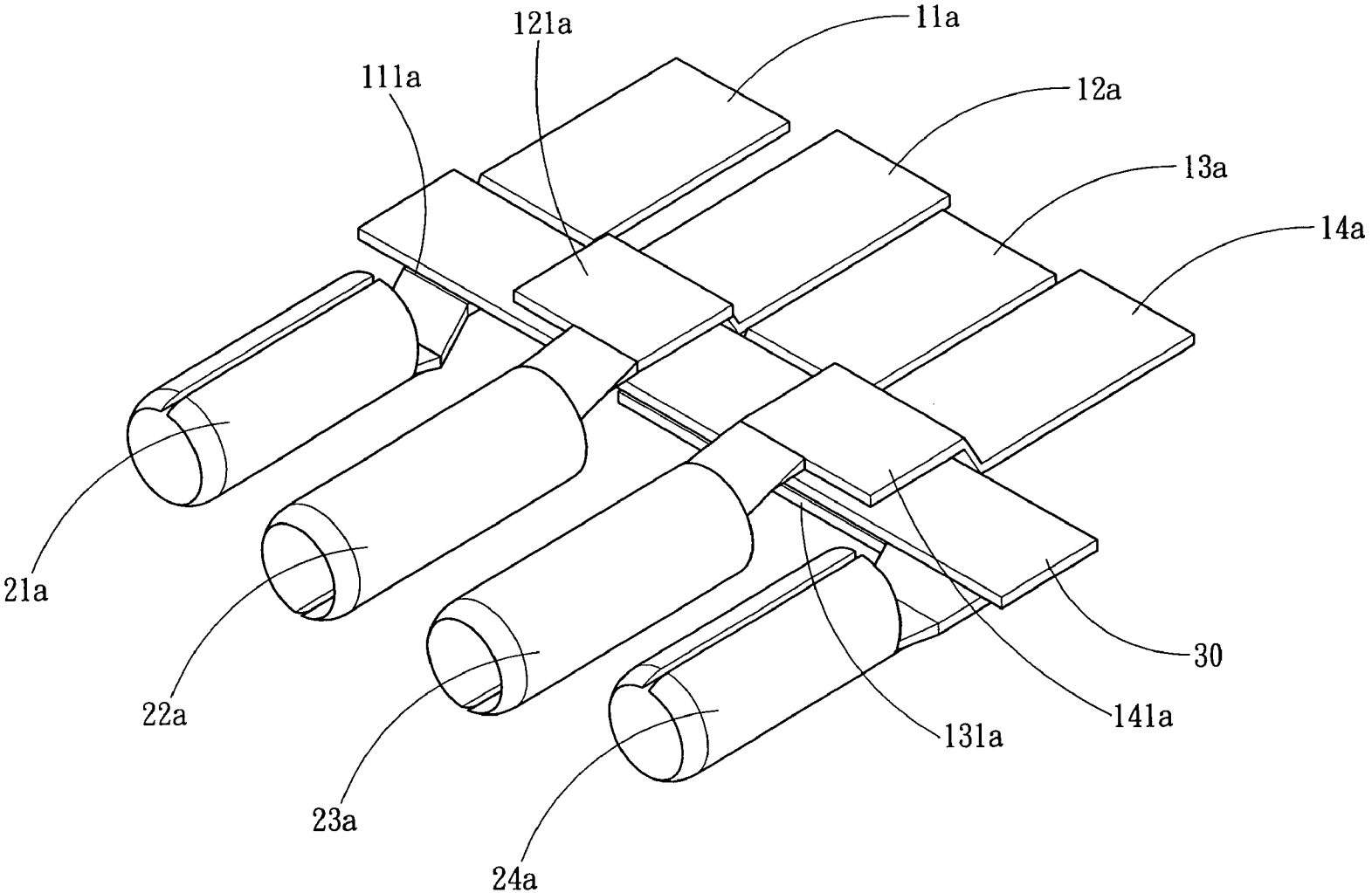
FIG. 4 is a diagram schematically showing the terminal arrangement of the power connector according to another embodiment of the present invention.
Figure 5:
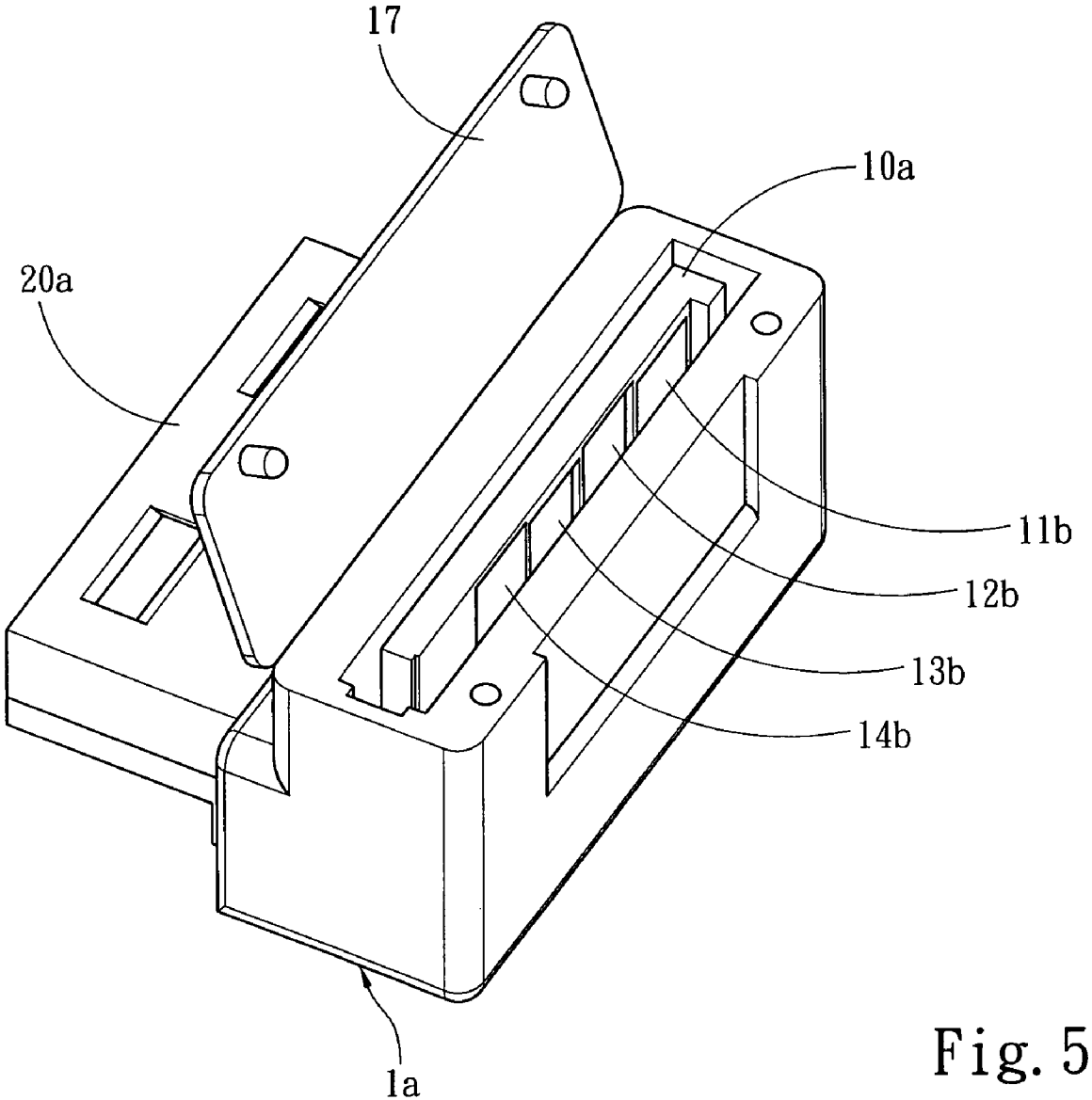
FIG. 5 is a diagram schematically yet another embodiment of the present invention.

Refer to FIG. 4 a diagram schematically showing the terminal arrangement of the power connector according to another embodiment of the present invention. The power terminals 21*a*~24*a* of the IDE connect port 20 are arranged according to the sequence: L, G, G, L; the SATA connect port 10 has at least the terminals corresponding to the IDE connect port 20 in potential, and the power terminals 11*a*~14*a* of the SATA connect port 10 are arranged according to the sequence: L, G, L, G. There are connect segments 111*a*~141*a* respectively between the power terminals 21*a*~24*a* and the power terminals 11*a*~14*a*. The ground-wire power terminals 12*a* and 14*a* are of the same potential; the ground-wire power terminals 22*a* and 23*a* also has the same potential as the terminals 12*a* and 14*a*; the ground-wire power terminals 22*a* and 23*a* are respectively opposite to the ground-wire terminals 12*a* and 14*a*; therefore, the terminals 12*a* and 14*a* can utilize the connection segments 121*a* and 141*a* to directly butt with the terminals 22*a* and 23*a* without turnings. The live-wire power terminal 11*a* and the live-wire power terminal 21*a* are of the same potential, and they directly butts to each other with the connect segment 111*a* without any turning. The live-wire power terminal 13*a* and the power terminal at its opposite side are of different potential; the live-wire power terminal 13*a* utilizes the crooked connection segment 131*a* to cross over the connection segment 141*a* of the neighboring ground-wire power terminals 14*a* and to connect with the equipotential live-wire power terminal 24*a*. The connection segment 131*a* of the live-wire power terminal 13*a* is raised with an increment to cross over the connection segments 141*a* of the live-wire power terminal 14*a*. An insulation element 30 is interposed between the level of the connection segments 121*a* and 141*a* and the level of the connection segments 111*a* and 131*a*. The abovementioned SATA connect port 10 and IDE connect port 20 are on parallel planes. However, they may also be disposed on the planes perpendicular to each other, as show in FIG. 5, in order to adapt to various insertion situations.

Figure 6A:
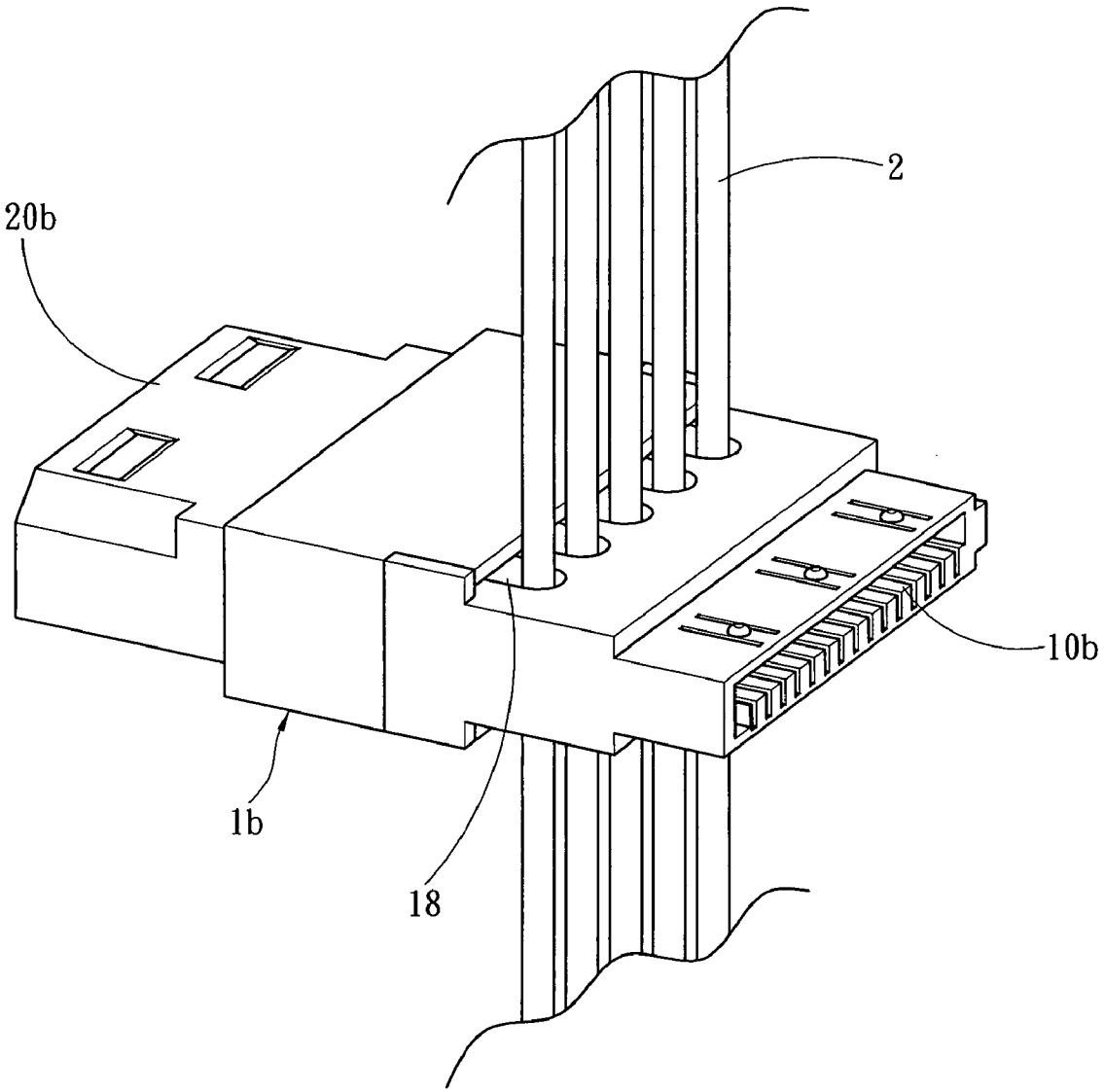
FIG. 6A is a diagram schematically showing a perspective view of the power connector according to further another embodiment of the present invention.
Figure 6B:
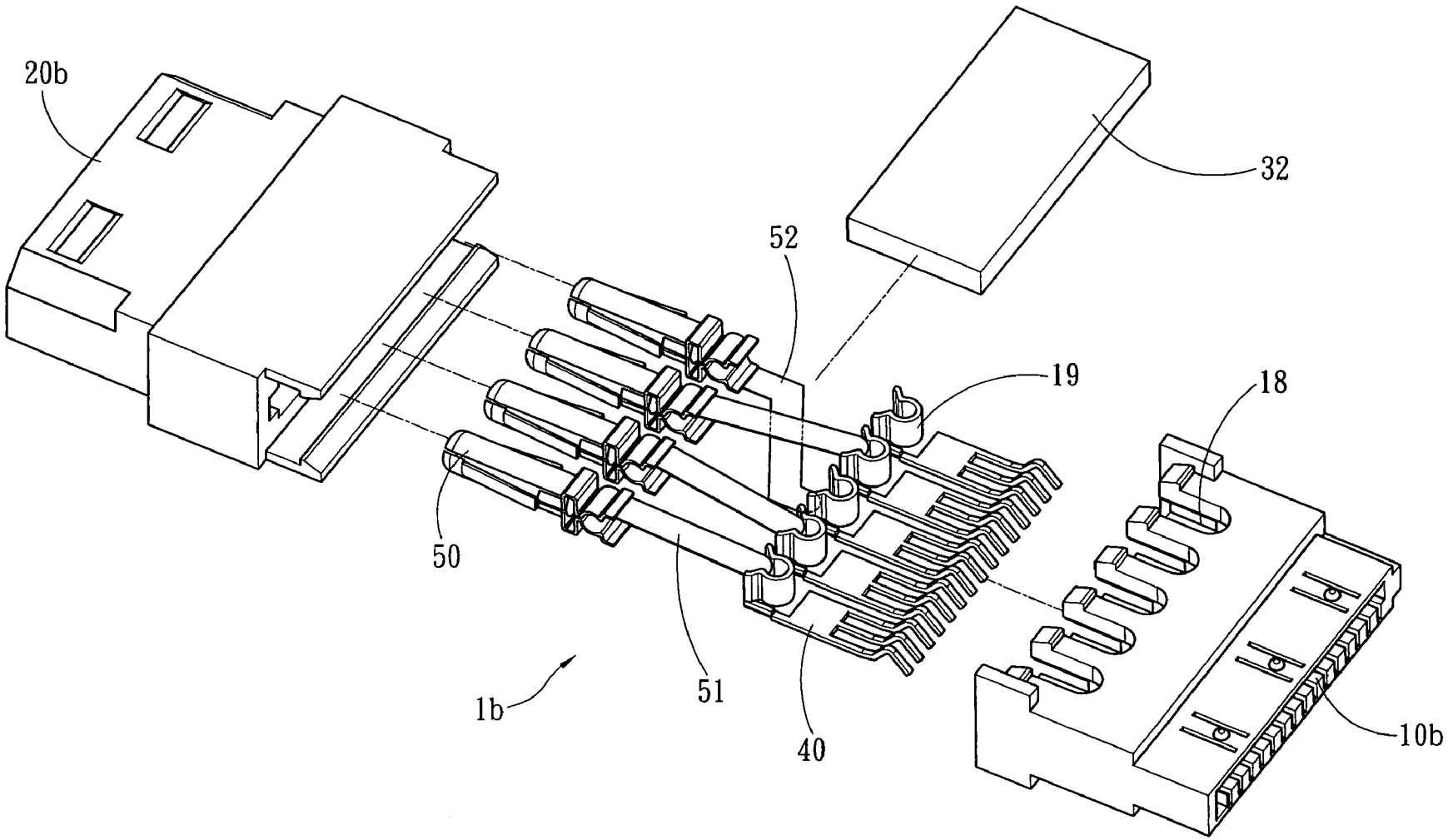
FIG. 6B is a diagram schematically showing an exploded view of the power connector according to further another embodiment of the present invention.

Refer to FIG. 6A and FIG. 6B diagrams schematically showing further another embodiment of the present invention. As shown in the drawings, the power connector 1*b* is a common connector for SATA and IDE power supplies; one side thereof is a SATA connect port 10*b*, and the other side is an IDE connect port 20*b*. Through holes 18 for power wires 2 are installed on the SATA connect port 10*b*. The SATA connect port 10*b* and IDE connect port 20*b* respectively contain multiple power terminals 40 and 50, and electric connecting elements 19 for power wires 2 are installed to the power terminals 40. The power terminal 50 utilizes a connection segment 51 to connect with an equipotential power terminal 40 without deflection. The power terminal 50, which has a non-equipotential opposite power terminal 40, utilizes a crooked and raised connection segment 52 to cross over the other connection segments and to connect with another equipotential power terminal 40. An insulation element 32 is interposed into the gap between the segments 51 and 52; the implementation thereof is similar to those described above and no more described here.

In summary, the present invention proposes a power connector meeting SATA and IDE standards, wherein the power connector 1~1*b* has a SATA connect port 10~10*b* on one side and has an IDE connect port 20~20*b* on the other side; the user can easily obtain an IDE power supply from an original SATA power supply via the power connector of the present invention when he needs an IDE power connector, which not only provides users with convenient SATA/IDE power supply switching but also benefits the manufacturers from the reduced cost of stock management. So far, the power connector of the present invention, which can switch between SATA and IDE power supplies, has not been found in the related field yet.

The invention being thus described, it will be obvious that the same way be varied in many ways. Such Variations are not to be regarded as a departure from the spirit and scope of the invention, and all such modifications as would be obvious to one skilled in the art are intended to be included within the scope of the following claims.

What is claimed is:

1. A power connector meeting SATA and IDE standards, characterized in that one side of said power connector is a SATA connect port, and the other side is an IDE connect port; said power connector contains a plurality of live-wire power terminals L and multiple ground-wire power terminals G; said power terminals of said IDE connect port are arranged according to the sequence: L, G, Q L, and said power terminals of said SATA connect port are arranged according to the sequence: L, G, L, G; said live-wire power terminal L, which has a non-equipotential opposite power terminal, utilizes a crooked connection segment to cross over neighboring ground-wire power terminals G and to connect with another equipotential live-wire power terminal L.

2. The power connector meeting SATA and IDE standards according to claim 1, wherein connection segments of said live-wire power terminals L have different raised increments and cross over each other.

3. The power connector meeting SATA and IDE standards according to claim 2, wherein an insulation element is interposed into the gap between said connection segments having different raised increments.

4. The power connector meeting SATA and IDE standards according to claim 1, wherein each said power terminal has a connection segment to connect with an equipotential power terminal.

5. The power connector meeting SATA and IDE standards according to claim 1, wherein when said power connector is a SATA/IDE conversion connector, the residual potential is an empty potential.

6. The power connector meeting SATA and IDE standards according to claim 1, wherein when said power connector is a common connector for SATA and IDE power supplies, through holes and electric connecting elements are respectively installed to said power connector and corresponding power thermals.

7. The power connector meeting SATA and IDE standards according to claim 1, wherein a cover is pivotedly installed to the opening of SATA connect port.

8. The power connector meeting SATA and IDE standards according to claim 1, wherein said SATA connect port and said IDE connect port are on parallel planes.

9. The power connector meeting SATA and IDE standards according to claim 1, wherein said SATA connect port and said IDE connect port are disposed on the planes perpendicular to each other.

10. The power connector meeting SATA and IDE standards according to claim 1, wherein said two live-wire power terminals are of different potentials and respectively have crooked connection segments with increments raised to different altitudes to cross over neighboring ground-wire power terminals G and to connect with other equipotential live-wire power terminals.

11. The power connector meeting SATA and IDE standards according to claim 10, wherein an insulation element is interposed into the gap between said live-wire power terminals L and said ground-wire power terminals G.

12. The power connector meeting SATA and IDE standards according to claim 11, wherein an insulation element is interposed into the gap between said live-wire power terminals L.

13. The power connector meeting SATA and IDE standards according to claim 10, wherein each said power terminal has a connection segment to connect with another equipotential power terminal.

14. The power connector meeting SATA and IDE standards according to claim 10, wherein when said power connector is a SATA/IDE conversion connector, the residual potential is an empty potential.

15. The power connector meeting SATA and IDE standards according to claim 10, wherein when said power connector is a common connector for SATA and IDE power supplies, through holes and electric connecting elements are respectively installed to said power connector and corresponding power thermals.

16. The power connector meeting SATA and IDE standards according to claim 10, wherein a cover is pivotedly installed to the opening of SATA connect port.

17. The power connector meeting SATA and IDE standards according to claim 10, wherein said SATA connect port and said IDE connect port are on parallel planes.

18. The power connector meeting SATA and IDE standards according to claim 10, wherein said SATA connect port and said IDE connect port are disposed on the planes perpendicular to each other.

* * * * *